US009142159B2

(12) United States Patent
Inoue et al.

(10) Patent No.: US 9,142,159 B2
(45) Date of Patent: Sep. 22, 2015

(54) METHOD FOR UNEVEN LIGHT EMISSION CORRECTION OF ORGANIC EL PANEL AND DISPLAY CORRECTION CIRCUIT OF ORGANIC EL PANEL

(71) Applicant: Sony Corporation, Tokyo (JP)

(72) Inventors: Yasuo Inoue, Tokyo (JP); Ken Kikuchi, Tokyo (JP); Takeya Meguro, Tokyo (JP); Hideto Mori, Kanagawa (JP)

(73) Assignee: JOLED INC., Tokyo (JP)

( * ) Notice: Subject to any disclaimer, the term of this patent is extended or adjusted under 35 U.S.C. 154(b) by 13 days.

(21) Appl. No.: 14/177,727

(22) Filed: Feb. 11, 2014

(65) Prior Publication Data

US 2014/0192099 A1 Jul. 10, 2014

Related U.S. Application Data

(63) Continuation of application No. 12/115,979, filed on May 6, 2008.

(30) Foreign Application Priority Data

May 11, 2007 (JP) ..... 2007-126506

(51) Int. Cl.
*G09G 5/10* (2006.01)
*G09G 3/32* (2006.01)

(52) U.S. Cl.
CPC ..... *G09G 3/3208* (2013.01); *G09G 3/3233* (2013.01); *G09G 2300/08* (2013.01); (Continued)

(58) Field of Classification Search
CPC ..... G09G 2320/046; G09G 2320/0673; G09G 2320/0233; G09G 3/3233; G09G 3/3208; G09G 2300/08; G09G 2320/0223; G09G 2320/0276; G09G 2320/043; G09G 2320/0666; G09G 2320/103; G09G 2320/029; G09G 2360/16; G09G 2320/0626
USPC ..... 345/76–77, 690
See application file for complete search history.

(56) References Cited

U.S. PATENT DOCUMENTS 4,559,535 A 12/1985 Watkins et al.
5,764,209 A 6/1998 Hawthorne et al.

(Continued)

FOREIGN PATENT DOCUMENTS

JP 2002-175041 6/2002
JP 2003-015604 1/2003

(Continued)

OTHER PUBLICATIONS

Japanese Patent Office Action issued in connection with corresponding Japanese patent application No. P2007-126506 dated Jul. 22, 2009.

(Continued)

*Primary Examiner* — Towfiq Elahi
(74) *Attorney, Agent, or Firm* — Dentons US LLP

(57) ABSTRACT

A correction method for correcting uneven light emission of an organic EL panel, the correction method includes the steps of: supplying a predetermined signal to the organic EL panel to detect the brightness of the panel at horizontal and vertical scan positions; forming, based on a detection output thereof, correction data adapted to correct uneven brightness of the organic EL panel at a horizontal or vertical display position of the panel; storing the correction data in a memory; and reading the correction data from the memory during viewing to correct the level of a video signal supplied to the organic EL panel.

2 Claims, 8 Drawing Sheets

(52) U.S. Cl.
CPC .. *G09G2320/029* (2013.01); *G09G 2320/0223* (2013.01); *G09G 2320/0233* (2013.01); *G09G 2320/0276* (2013.01); *G09G 2320/043* (2013.01); *G09G 2320/0666* (2013.01); *G09G 2320/103* (2013.01); *G09G 2360/16* (2013.01)

(56) References Cited

U.S. PATENT DOCUMENTS

| | | | | |
|---|---|---|---|---|
| 7,053,874 | B2 | 5/2006 | Koyama | |
| 7,618,146 | B2 | 11/2009 | Matsushita | |
| 2002/0033783 | A1* | 3/2002 | Koyama | 345/82 |
| 2003/0091230 | A1* | 5/2003 | Choi et al. | 382/162 |
| 2005/0093850 | A1* | 5/2005 | Mori et al. | 345/204 |
| 2006/0007211 | A1* | 1/2006 | Murayama et al. | 345/204 |
| 2006/0262147 | A1 | 11/2006 | Kimpe et al. | |
| 2006/0279477 | A1 | 12/2006 | Allen et al. | |
| 2007/0052633 | A1 | 3/2007 | Sato et al. | |
| 2007/0070085 | A1* | 3/2007 | Yamagata et al. | 345/606 |
| 2007/0229480 | A1* | 10/2007 | Ookawara | 345/204 |
| 2007/0242002 | A1* | 10/2007 | Kawabe | 345/76 |

FOREIGN PATENT DOCUMENTS

| | | |
|---|---|---|
| JP | 2004-140702 | 5/2004 |
| JP | 2005-316408 | 11/2005 |
| JP | 2007-316408 | 11/2005 |
| JP | 2007-41296 | 2/2007 |
| JP | 2007-086579 | 5/2007 |
| KR | 10-2005-0089738 | 9/2005 |

OTHER PUBLICATIONS

Japanese Patent Office Action issued in connection with related Japanese patent application No. 2007-126506 dated Apr. 30, 2009.
Japanese Patent Office Action issued in connection with related Japanese patent application No. 2007-126506 dated Oct. 14, 2009.
Korean Office Action issued in connection with related Korean Patent Application No. 10-2008-0037116 dated Apr. 7, 2014.

* cited by examiner

VALUE
DB1H
(DB2H,DB3H)
AVERAGE
VALUE
AVERAGE
DB1V
(DB2V,DB3V)
DB1
(DB2
DB3)

DC1
(DC2
DC3)
HORIZONTAL
DIRECTION

SIGNAL
VOLTAGE
BRIGHT-
NESS
V3
V2
V1
L3
L2
L1
0
VERTICAL DIRECTION

METHOD FOR UNEVEN LIGHT EMISSION CORRECTION OF ORGANIC EL PANEL AND DISPLAY CORRECTION CIRCUIT OF ORGANIC EL PANEL

CROSS REFERENCES TO RELATED APPLICATIONS

This application is a continuation of U.S. patent application Ser. No. 12/115,979 filed May 6, 2008, the entirety of which is incorporated herein by reference to the extent permitted by law. The present invention contains subject matter related to Japanese Patent Application JP 2007-126506 filed with the Japan Patent Office on May 11, 2007, the entire contents of which being incorporated herein by reference to the extent permitted by law.

BACKGROUND OF THE INVENTION

1. Field of the Invention

The present invention relates to a method for an uneven light emission correction of an organic EL panel and a display correction circuit of an organic EL panel.

2. Description of the Related Art

Some panel-shaped display devices for displaying a TV image or the like use an organic EL panel. The organic EL panel has a plurality of organic EL elements arranged in a matrix form. Each of the organic EL elements is associated with one pixel (one of the red, green and blue pixels).

FIG. 7 illustrates the principle of a drive circuit for an organic EL element. A drive TFT (Q) and organic EL element D are connected in series to a power source +VDD. The TFT (Q) is supplied with a video signal voltage V.

Therefore, the signal voltage V is converted into a signal current I by the TFT (Q). The signal current I flows through the organic EL element D. This causes the organic EL element D to emit light L at the brightness (emission intensity) associated with the magnitude of the signal current I. As a result, the pixel is displayed at the brightness associated with the signal voltage V.

As described above, a display device using an organic EL panel can be reduced in thickness because it is self-luminous and therefore demands no backlights as does the liquid crystal display. Further, the light emission thereof is achieved by excitons in the organic semiconductor. As a result, the display device has high energy conversion efficiency, making it possible to reduce the voltage demanded for light emission down to several volts or so.

Further, the organic EL panel offers high response speed and wide color reproduction range. Still further, the panel is immune to magnetic field interference unlike the cathode ray tube (picture tube). It should be noted that the organic EL is also called the organic LED or OLED.

The following document is available as an existing art document: Japanese Patent Laid-Open No. 2003-15604, hereinafter referred to as Patent Document 1.

SUMMARY OF THE INVENTION

Patent Document 1 discloses a technique for preventing horizontal crosstalk. Horizontal crosstalk is a phenomenon by which the more pixels per line, the higher the potential of the line scanning wiring, and therefore the darker the line is displayed.

In addition to uneven light emission caused by horizontal crosstalk, however, organic EL panels are often prone to typical uneven light emission across the panel resulting from their manufacturing method. That is, the manufacturing of organic EL panels involves the TFT manufacturing process. The TFT manufacturing process includes an exposure process using a laser beam. The exposure process is designed to vertically expose the panel to a laser beam which has been spread out in a fan-like manner using optical means. At the same time, the panel is moved horizontally so that the entire panel surface is exposed to the laser beam.

For this reason, uneven exposure is likely to occur in the vertical and horizontal directions in organic EL panels. This often leads to uneven light emission in a striped fashion in the same directions across the panel surface.

FIG. 8A illustrates an observation example of uneven light emission in an organic EL panel. FIG. 8B is a graph of the vertical brightness L at a horizontal position X of the organic EL panel as illustrated in FIG. 8A. FIG. 8C is a graph of the horizontal brightness L at a vertical position Y of the organic EL panel as illustrated in FIG. 8A. It should be noted that uneven light emission is exaggerated for easy understanding and the contrast has been converted into binary data by dithering in FIGS. 8A to 8C. Uneven light emission in a striped fashion, and particularly stripes of uneven light emission stretching in the horizontal direction (horizontal uneven light emission in a striped fashion), are obvious in FIGS. 8A to 8C.

A possible solution to suppressing such uneven light emission in a striped fashion would be to improve the organic EL panel itself by reassessing the manufacturing process. Nevertheless, there is a limit to the improvement, and the above approach may lead to reduced manufacturing yield or higher cost.

In light of the foregoing, there is a need for the present invention to reduce or eliminate vertical and horizontal uneven light emission in a striped fashion in a display device having an organic EL panel without reducing the manufacturing yield of the organic EL panel.

A correction method for correcting uneven light emission of an organic EL panel according to the present embodiment is characterized as follows: That is, the method first supplies a predetermined signal to the organic EL panel to detect the brightness of the panel at horizontal and vertical scan positions. Next, the method forms, based on a detection output thereof, correction data adapted to correct uneven brightness of the organic EL panel at a horizontal or vertical display position of the panel. Then, the method stores the correction data in a memory. Finally, the method reads the correction data from the memory during viewing to correct the level of a video signal supplied to the organic EL panel.

On the other hand, a display correction circuit of an organic EL panel according to the present embodiment is characterized as follows: That is, the display correction circuit includes a memory and correction circuit. The memory stores correction data adapted to correct uneven brightness of the organic EL panel at a horizontal or vertical display position of the panel. The correction circuit corrects the level of a video signal supplied to the organic EL panel based on the correction data stored in the memory.

The present embodiment ensures high efficiency in the correction of uneven light emission in a striped fashion on an organic EL panel using correction data, thus providing a high quality image on the screen. Further, the present embodiment can eliminate the reduction in manufacturing yield of the organic EL panel, thus maintaining high productivity.

DETAILED DESCRIPTION OF THE PREFERRED EMBODIMENT

[1] Example of the Overall Configuration and Operation

Figure 1:
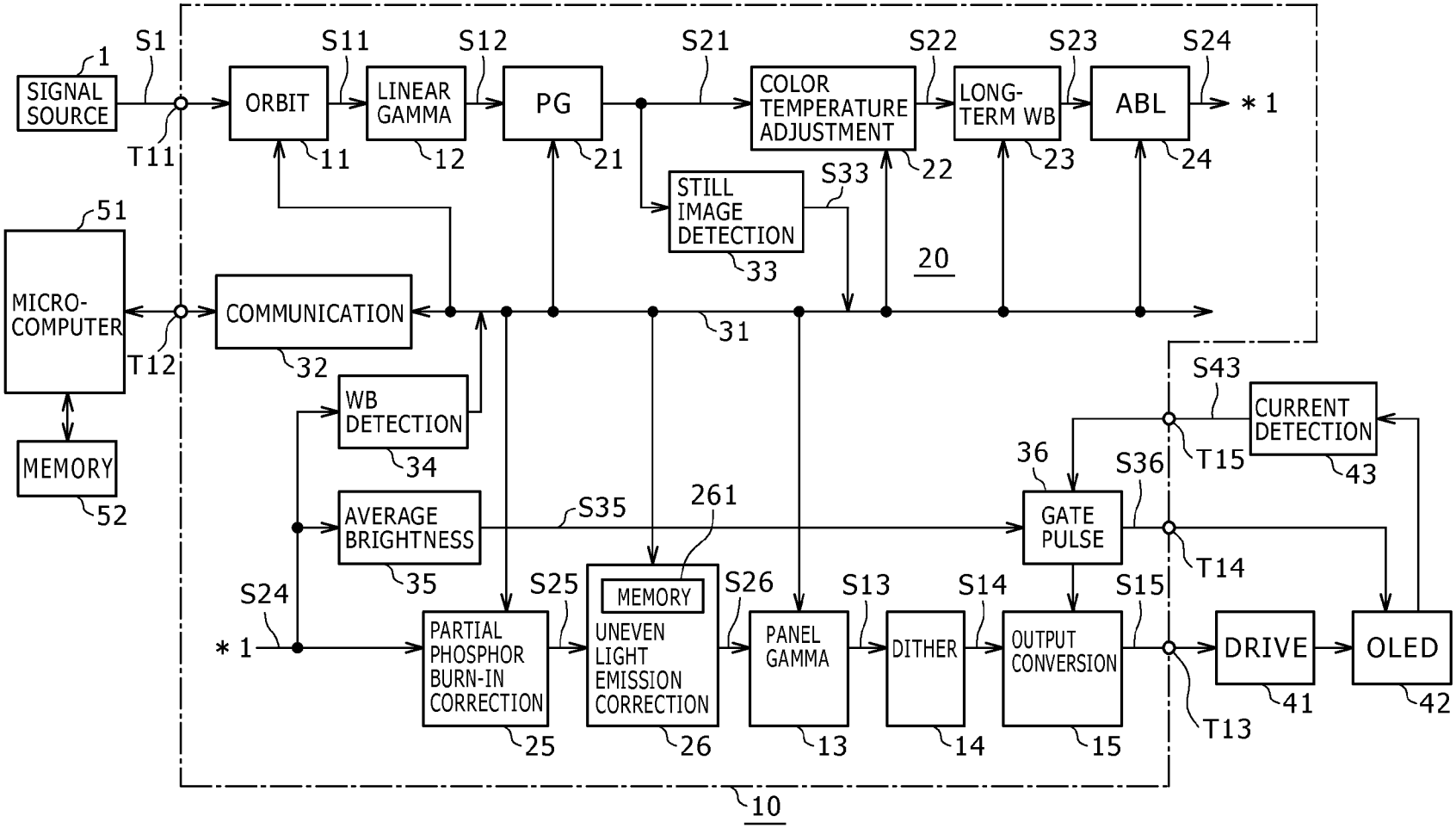
FIG. 1 is a system diagram for illustrating an embodiment of the present invention.

FIG. 1 illustrates an example of a display correction circuit according to the present embodiment and an example of use thereof. In this example, the display correction circuit is designed to not only correct vertical and horizontal uneven light emission in a striped fashion but also handle various corrections other than the above and the gamma correction.

Figure 7:
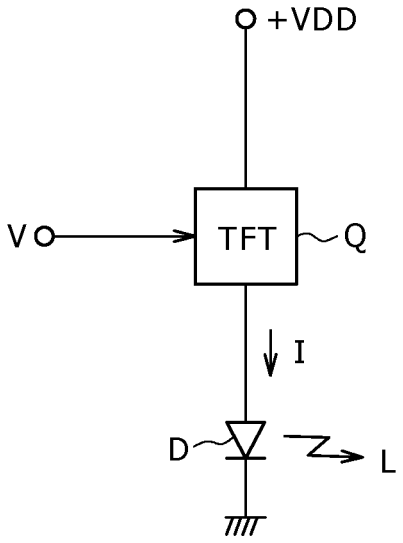
FIG. 7 is a connection diagram for describing the characteristic of an organic EL element.
Figure 9A:
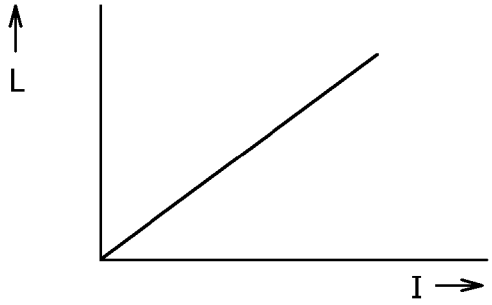
FIGS. 9A to 9E are characteristic diagrams for describing the operation of the organic EL element shown in FIG. 7.
Figure 9B:
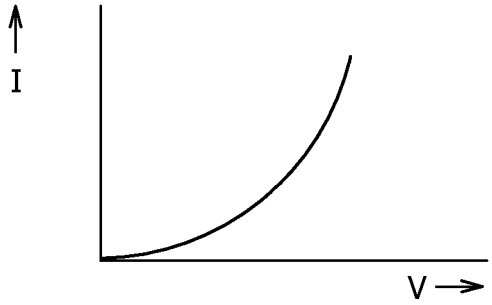

That is, the signal current I and brightness (emission intensity) L of the organic EL element D (FIG. 7) are linearly proportional to each other as illustrated in FIG. 9A. However, if the signal voltage V is supplied to the TFT (Q), the relation between the signal voltage V and signal current I changes to an exponential characteristic as illustrated in FIG. 9B because of the input/output characteristic of the TFT (Q). As a result, the relation between the signal voltage V and brightness L of the organic EL element D has an exponential characteristic as illustrated in FIG. 9C.

Figure 9C:
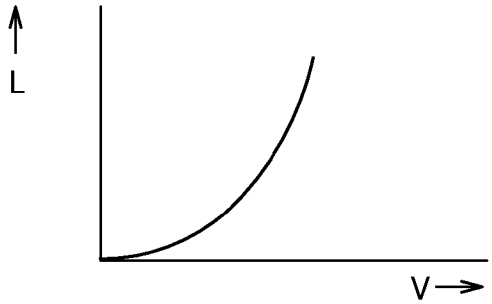
Figure 9D:
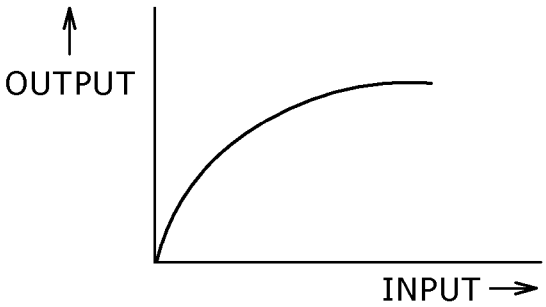
Figure 9E:
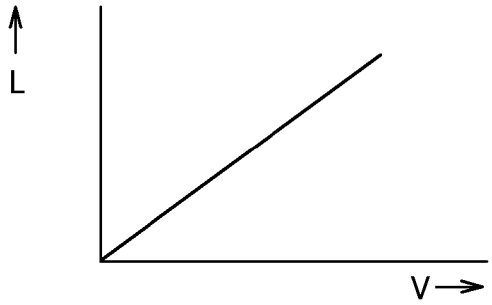

As illustrated in FIG. 9D, therefore, the display device using an organic EL panel must have a correction circuit having an exponential input/output characteristic which is complementary to the characteristic shown in FIG. 9C. Using this correction circuit, the video signal must be corrected so that the signal voltage V (before correction) and brightness L are linearly proportional to each other as illustrated in FIG. 9E. However, this inverse gamma correction is performed differently depending on the variation of the characteristic of the TFT (Q). Therefore, it is preferable to set a correction value appropriate for each organic EL panel.

On the other hand, a video signal used, for example, in television broadcasting is gamma-corrected before being fed to the cathode ray tube so that the signal voltage and brightness are linearly proportional to each other. However, the characteristic of the gamma correction for the cathode ray tube differs from that of the gamma correction demanded for the organic EL elements (FIG. 9D). For a display device using an organic EL panel, therefore, the difference in characteristic must be considered between the gamma correction for the cathode ray tube and that for the organic EL elements.

An area 10 enclosed by a dashed line in FIG. 1 illustrates the display correction circuit for high quality picture. This circuit is incorporated in an LSI or implemented on a single IC chip by using FPGA. The IC (display correction circuit) 10 has terminal pins T11 to T15 for external connections.

Figure 2A:
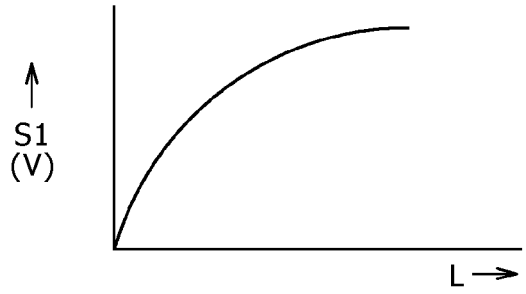
FIGS. 2A to 2E and 3 are characteristic diagrams for describing the operation of a circuit shown in FIG. 1.

Reference numeral 1 illustrates a signal source such as tuner circuit or DVD player. A video signal (three-primary-color signal made up of red, green and blue) S1 is supplied from the signal source 1. The video signal S1 is a digital signal and has a standard comparable to the video signal used in television broadcasting. As illustrated in FIG. 2A, therefore, the video signal S1 undergoes the gamma correction for the cathode ray tube.

Further, reference numeral 42 illustrates an organic EL panel for image display. This organic EL panel includes a plurality of organic EL elements arranged in a matrix form, with a drive TFT provided for each of the organic EL elements, as described in relation to FIG. 7. Further, the same panel has a light emission characteristic in which the brightness L increases exponentially with the signal voltage V as illustrated in FIG. 9C. It should be noted that the aspect ratio of the EL panel 42 is, for example, 16:9.

Reference numeral 51 illustrates a control microcomputer which controls the corrections performed in the display correction circuit 10 automatically or at the instruction of external equipment. A non-volatile memory 52, adapted to store various pieces of data and history records, is connected to the microcomputer 51.

The video signal S1 from the signal source 1 is supplied to an orbit circuit 11 via the terminal pin T11 of the IC 10. The orbit circuit 11 periodically shifts the entire image on the organic EL panel 42 in vertical and horizontal directions slowly enough to be unnoticed by the viewer so as to make any phosphor burn-in of the panel 42 inconspicuous. That is, by doing so, any phosphor burn-in resulting from the display of a still image or standard 4:3 image over a long period of time will be inconspicuous because the outline thereof is blurred. Thus, a video signal S11 reduced in phosphor burn-in is extracted from the orbit circuit 11.

Figure 2B:
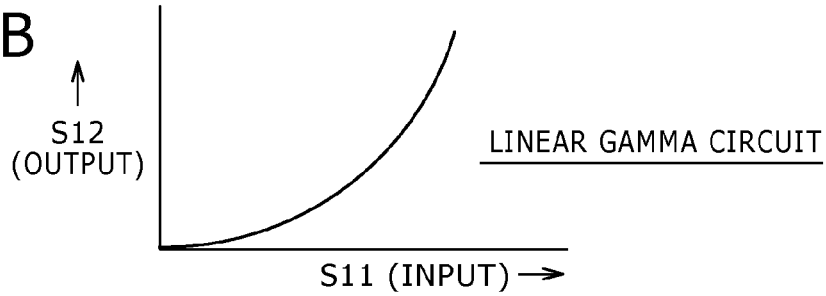

Next, the video signal S11 is supplied to the linear gamma circuit 12 which corrects the same signal S11 into a video signal S12. The linear gamma circuit 12 cancels the gamma characteristic of the video signal S11. As a result, the video signal S12 has an input/output characteristic as illustrated in FIG. 2B which is complementary to the gamma characteristic (FIG. 2A) of the video signal S11.

Figure 2C:
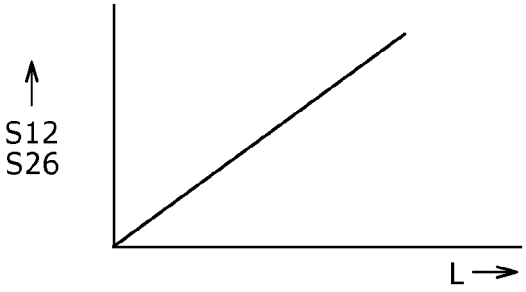

Therefore, the linear gamma circuit 12 outputs the video signal S12. The video signal S12 has a characteristic in which the signal voltage V changes linearly to the subject brightness L as illustrated in FIG. 2C. It should be noted that the video signal S12 is 14 bits per sample.

The video signal S12 is supplied to a correction circuit 20. Although described in detail later in Section [2], the correction circuit 20 includes circuits 21 to 26 and performs the various corrections under the control of the microcomputer 51. The correction circuit 20A outputs a corrected video signal S26. It should be noted that the video signal S26 changes linearly to the brightness L as illustrated in FIG. 2C.

Figure 2D:
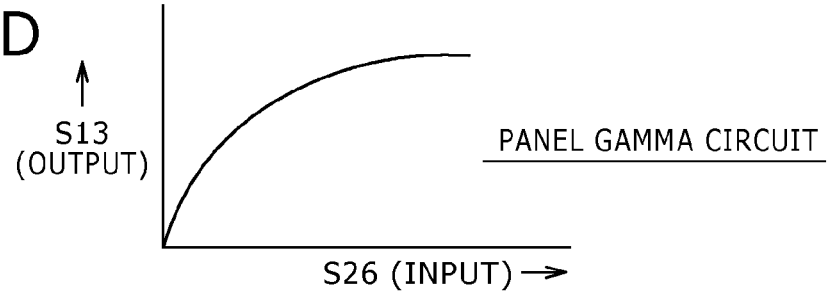

The video signal S26 is supplied to a panel gamma circuit 13 which corrects the same signal S26 into a video signal S13. The panel gamma circuit 13 cancels the gamma characteristic of the organic EL panel 42 by adding a predetermined gamma characteristic to the video signal S13. As illustrated in FIG. 2D, therefore, the panel gamma circuit 13 has an input/output characteristic which is complementary to the characteristic in FIG. 9C (characteristic same as that in FIG. 9D).

Further, the video signal S13 is supplied to a dither circuit 14 which corrects the same signal S13 into a video signal S14. The video signal S14 is a dithered signal which is 10 bits per sample. The video signal S14 is supplied to an output conversion circuit 15. The output conversion circuit 15 converts the three-primary-color signal into a video signal S15, for example, in RSDS (registered trademark) format. The video signal S15 is extracted from the terminal pin T13.

The video signal S15 extracted from the terminal pin T13 is supplied to a drive circuit 41 which converts the same signal S15 into analog form. Then, the resultant signal is supplied to the organic EL panel 42. As a result, the video signal S1 from the signal source 1 is displayed on the organic EL panel 42 as a color image.

[2] Example of Configuration and Operation of the Correction Circuit 20

The correction circuit 20 is configured and operates, for example, as described below. That is, the display correction circuit 10 has a control bus line 31. The same line 31 is connected to the terminal pin T12 via a communication circuit 32. The control microcomputer 51 is connected to the terminal pin T12.

Then, the video signal S12 from the linear gamma circuit 12 is supplied to the pattern generator circuit 21. The pattern generator circuit 21 outputs the supplied video signal S12 in an as-is manner as a video signal S21 during normal viewing. During adjustment or inspection of the organic EL display device using the display correction circuit 10 and organic EL panel 42, however, the same circuit 21 forms a video signal for various kinds of adjustments or tests which will be displayed as a test pattern or color bar and outputs this signal rather than the video signal S12 as the video signal S21.

For this reason, the microcomputer 51 supplies a control signal to the pattern generator circuit 21 via the communication circuit 32 to switch the operation of the same circuit 21, for example, between the following three different modes:

1. output the video signal S12 from the linear gamma circuit 12 in an as-is manner
2. form and output a video signal to be displayed as a test pattern or color bar
3. form and output a video signal having a given level to provide a uniform brightness across the screen It should be noted that this switching is accomplished by the viewer or manufacturer's personnel in charge of inspection or adjustment issuing an instruction to the microcomputer 51 via the main microcomputer (not shown).

The video signal S21 (video signal for broadcasting or other use under normal conditions) from the pattern generator circuit 21 is supplied to a still image detection circuit 33. The same circuit 33 detects whether the image displayed according to the video signal S21 is a still image. A detection signal S32 thereof is supplied to the microcomputer 51 via the communication circuit 32.

As a result, the microcomputer 51 forms a predetermined control signal based on the detection signal S33. Further, the microcomputer 51 supplies the control signal to the orbit circuit 11 via the communication circuit 32. As describe above, if the image displayed according to the video signal S21 is a still image, the orbit circuit 11 controls the display position thereof, thus reducing or making inconspicuous any phosphor burn-in of the organic EL panel 42. It should be noted that this process can be achieved by shifting the portion of the waveform of the video signal S11 to be displayed as an image relative to vertical and horizontal synchronizing signals.

Furthermore, the video signal S21 from the pattern generator circuit 21 is supplied to the color temperature adjustment circuit 22. In addition, when the viewer or manufacturer's personnel in charge of inspection or adjustment issues an instruction to the microcomputer 51 to adjust and set the color temperature via the main microcomputer, the microcomputer 51 sends this instruction to the color temperature adjustment circuit 22 via the communication circuit 32 so that the color temperature is adjusted and set to provide the intended characteristic.

Figure 3:
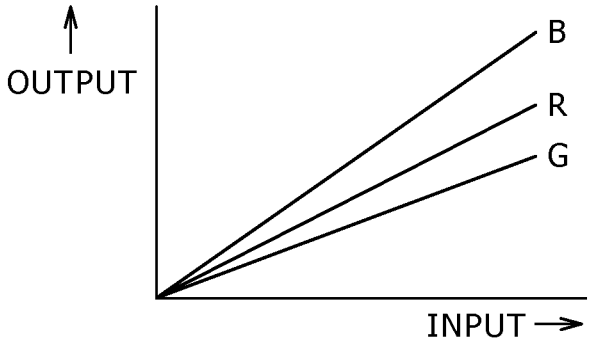

It should be noted that the adjustment and setting of the color temperature is accomplished, for example, by adjusting and setting the slope of the input/output characteristic in FIG. 3 for each of the three primary colors RGB. As described above, the video signal S21 is converted into a video signal S22 set at a given color temperature. The video signal S22 is output from a color temperature adjustment circuit 22.

Then, the video signal S22 is supplied to the long-term white balance correction circuit 23. The same circuit 23 corrects the change of white balance over time which occurs after an extended period of use of the organic EL panel 42, and then outputs a video signal S23 with corrected white balance.

Consequently, the video signal S24 from the ABL circuit 24, described later, is supplied to a white balance detection circuit 34 to correct the change of white balance over time. A detection signal S34 is extracted from the video signal (three-primary-color signal) S24 for each color signal. Each of the detection signals S34 indicates the voltage level of one of the color signals. The detection signals S34 are supplied to the microcomputer 51 via the communication circuit 32.

In this case, each of the detection signals S34 indicates the level of one of the color signals. Therefore, each of these signals indicates the brightness of one of the colors of the organic EL panel 42. Therefore, the microcomputer 51 accumulates the detection signals S34 for the three colors to calculate the accumulated amounts of light emission (brightness×time) the three colors.

The larger the accumulated amount of light emission, the lower the brightness of the organic EL panel 42. That is, the accumulated amount of light emission is also associated with the extent of deterioration of the brightness of each of the three colors of the organic EL panel 42. A table is stored in advance in a memory 52. The table indicates the extent of brightness deterioration for each color for the accumulated amount of light emission. The microcomputer 51 looks up this table based on the calculated accumulated amount of light emission to find a correction value for each color. The microcomputer 51 supplies these correction values to the long-term white balance correction circuit 23 via the communication circuit 32. As a result, the same circuit 23 changes the slope of the input/output characteristic in FIG. 3 to correct the change of white balance over time.

Then, the video signal S23 with corrected white balance is supplied to the ABL circuit 24. The same circuit 24 corrects the video signal S23 into a video signal S24 having a limited peak brightness. The video signal S24 is supplied to the partial phosphor burn-in correction circuit 25. The same circuit 25 detects partial phosphor burn-in based on the signal level and time, and then outputs a video signal S25 which has been corrected for phosphor burn-in.

The video signal S25 is supplied to the uneven light emission correction circuit 26. The same circuit 26 corrects the video signal S25. The uneven light emission correction circuit 26 corrects uneven light emission across the screen of the organic EL panel 42 although a detailed description thereof will be given later in Section [3]. Therefore, the video signal 26 from the correction circuit 20 has been not only subjected to various corrections by the circuits 21 to 25 but also corrected for uneven light emission by the uneven light emission correction circuit 26. The same signal S26 is supplied to the panel gamma circuit 13 as described above.

Further, the video signal S24 from the ABL circuit 24 is supplied to an average brightness detection circuit 35. The same circuit 35 detects, for example, the average brightness per frame based on the ratio of the voltages of the color signals contained in the video signal S24. A detection signal S35 thereof is supplied to a gate pulse circuit 36 as a control signal. The same circuit 36 controls the duty ratio of the light emission period of the organic EL panel 42, namely, the ratio of the light emission period of the organic EL panel 42 per frame.

Thus, the gate pulse circuit 36 outputs a control signal S36. The control signal S36 controls the duty ratio of the light emission period of the organic EL panel 42 in a frame succeeding the frame for which the duty ratio thereof has been calculated. The same signal S36 is supplied to the organic EL panel 42 via the terminal pin T14 as a duty ratio control signal for that light emission period, thus protecting the same panel 42.

At this time, the magnitude of the signal current I flowing through the organic EL panel 42 is also measured for each color by a current detection circuit 43. A detection signal S43 thereof is supplied to the gate pulse circuit 36 via the terminal pin T15. This causes the control signal S36 to be controlled in a frame succeeding the frame for which the signal current I flowing through the organic EL panel 42 was detected. As a result, the magnitude of the signal current is restricted in a frame succeeding the frame for which the signal current I flowing through the same panel 42 was detected, thus protecting the same panel 42 against the excessive signal current I.

Figures 8A, 8B, 8C:
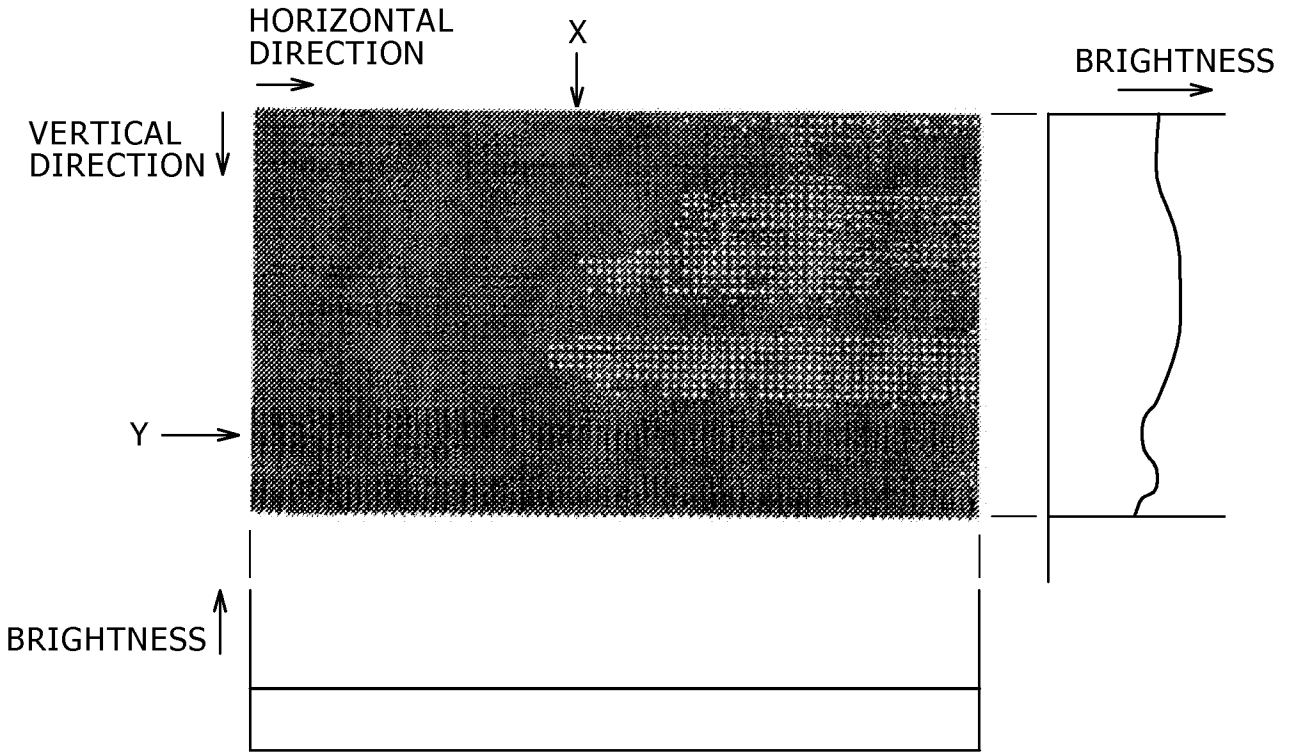
FIGS. 8A to 8C are diagrams for describing an observation example of a light emission characteristic of the organic EL panel.

[3] Description of the Uneven Light Emission Correction Circuit 26 and Example of Operation As described above and as illustrated in FIG. 8, the organic EL panel 42 is often prone to horizontal or vertical uneven light emission. However, such uneven light emission in a striped fashion remains almost constant in brightness along the stripe as illustrated in FIG. 8C. In addition to uneven light emission in a striped fashion, local uneven light emission may occur.

Therefore, the uneven light emission correction circuit 26 illustrated in FIG. 1 is adapted to correct uneven light emission in a striped fashion and local uneven light emission separately.

That is, we assume that the display surface of the organic EL panel 42 is captured with a video camcorder or other imaging means when the video signal S15 having a uniform level is supplied to the same panel 42. In this case, the imaging means produce an image capture signal (video signal) having a uniform level unless there is uneven light emission on the same panel 42. However, if there is uneven light emission on the same panel 42, the imaging means produce an image capture signal whose level changes according to the uneven light emission.

Therefore, the pattern generator 21 outputs the video signal S21 whose voltage changes between three constant levels V1, V2 and V3 and sequentially from V1 to V2 and V3 every several frames. As a result, the brightness L of the organic EL panel 42 changes between three levels L1, L2 and L3 and sequentially from L1 to L2 and L3 every several frames. That is, the organic EL panel 42 emits light across the surface at the brightness level which changes sequentially from the low level L1, to the medium level L2 and to the high level L3 every several frames.

Then, the entire surface of the organic EL panel 42 is captured with a video camcorder or other imaging element at each of the brightness levels L1, L2 and L3. An image capture signal (signal voltage) is extracted at each of the brightness levels L1, L2 and L3. These image capture signals are supplied to a dedicated external computer (not shown). As a result, three pieces of correction data DB1, DB2 and DB3 and three more pieces of correction data DC1, DC2 and DC3 are formed respectively for the brightness levels L1, L2 and L3.

Figures 4A, 4B, 4C:
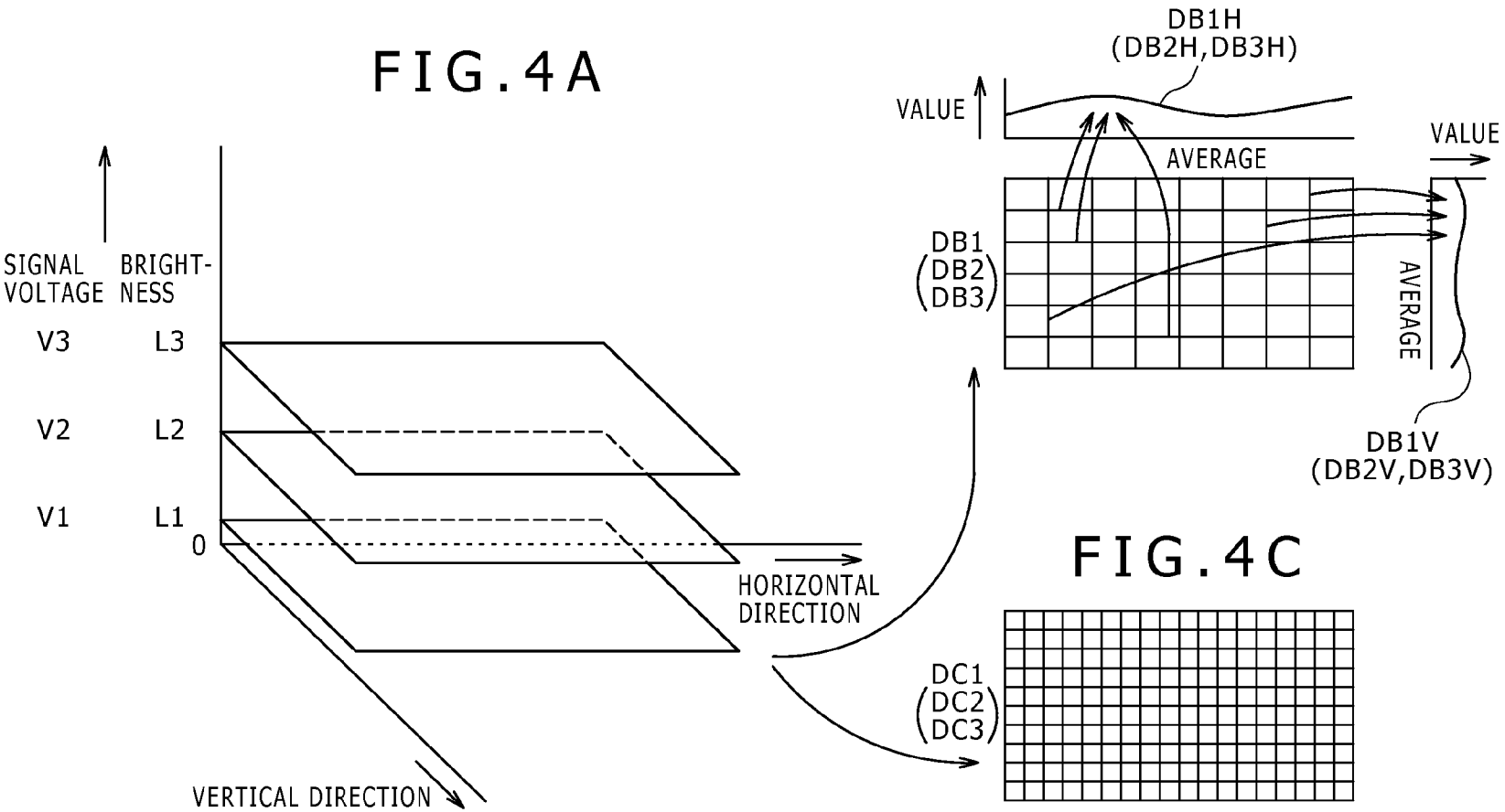
FIGS. 4A to 4C are diagrams for describing the operation of the circuit shown in FIG. 1.

In this case, the pieces of correction data DB1 to DB3 are adapted to correct horizontal and vertical uneven light emission in a striped fashion respectively at the brightness levels L1 to L3. As illustrated in FIG. 4B, the correction data DB1 for the brightness level L1 includes horizontal correction data DB1H and vertical correction data DB1V.

That is, assuming a plurality of horizontal lines relative to the organic EL panel 42, the horizontal correction data DB1H is average correction data for all the horizontal lines adapted to correct the brightness levels of the horizontal lines to the uniform brightness level L1. On the other hand, assuming a plurality of vertical lines relative to the organic EL panel 42, the vertical correction data DB1V is average correction data for all the vertical lines adapted to correct the brightness levels of the vertical lines to the uniform brightness level L1.

Therefore, the correction data DB1H changes complementarily relative to horizontal uneven light emission (brightness change) of the organic EL panel 42 at the brightness level L1. In contrast, the vertical correction data DB1V changes complementarily relative to vertical uneven light emission of the same panel 42 at the brightness level L1.

Similarly, the correction data DB2 for the brightness level L2 includes horizontal correction data DB2H and vertical correction data DB2V. The horizontal correction data DB2H is average correction data for uneven light emission of a plurality of horizontal lines. The vertical correction data DB2V is average correction data for uneven light emission of a plurality of vertical lines. Further, the correction data DB3 for the brightness level L3 includes horizontal correction data DB3H and vertical correction data DB3V. The horizontal correction data DB3H is average correction data for uneven light emission of a plurality of horizontal lines. The vertical correction data DB3V is average correction data for uneven light emission of a plurality of vertical lines.

On the other hand, the pieces of correction data DC1 to DC3 are primarily adapted to correct local uneven light emission. For this reason, assuming a plurality of horizontal and vertical lines relative to the organic EL panel 42 as illustrated in FIG. 4C, the correction data DC1 for the brightness level L1 includes horizontal correction data DC1H and vertical correction data DC1V respectively for horizontal and vertical lines.

Further, the correction data DC2 for the brightness level L2 includes horizontal correction data DC2H and vertical correction data DC2V, as with the correction data DC1 for the brightness level L1 which includes the correction data DC1H and DC1V. Still further, the correction data DC3 for the brightness level L3 includes horizontal correction data DC3H and vertical correction data DC3V, as with the correction data DC1 for the brightness level L1 which includes the correction data DC1H and DC1V.

It should be noted that the number of horizontal and vertical lines for the pieces of correction data DC1 to DC3 (FIG. 4C) may be equal to or greater than that for the pieces of correction data DB1 to DB3 (FIG. 4B). On the other hand, the pieces of correction data DB1 to DB3 and DC1 to DC3 are at least 10-bit accurate.

These pieces of correction data DB1 to DB3 and DC1 to DC3 are supplied from the dedicated computer, which created these pieces of data, to the non-volatile memory 52 via the microcomputer 52 for storage.

During normal viewing (and adjustment or inspection), all the pieces of correction data DB1 to DB3 and DC1 to DC3 are supplied to a memory 261 (which will be described later) of the uneven light emission correction circuit 26 via the communication circuit 32. Of all the pieces of data DB1 to DB3 and DC1 to DC3 supplied to the memory 261, the piece of data associated with the scan position (coordinate position) of the organic EL panel 42 and the brightness at that position is read. As a result, uneven light emission is corrected using the correction data read.

In this case, the pieces of correction data DB1 to DB3 are adapted to correct horizontal and vertical uneven light emission in a striped fashion. In the case of the correction data DB1V included in the correction data DB1, for example, the data DB1V associated with the vertical scan position is repeatedly read, irrespective of the horizontal scan position. This makes it possible to correct horizontal uneven light emission in a striped fashion at the brightness level L1, that is, stripes of uneven light emission stretching in the horizontal direction as illustrated in FIG. 8A.

That is, horizontal uneven light emission in a striped fashion remains almost constant in brightness in the horizontal direction. This makes it possible for the correction data DB1V to correct horizontal uneven light emission in a striped fashion.

Similarly, in the case of the correction data DB1H included in the correction data DB1, for example, the data DB1H associated with the horizontal scan position is repeatedly read, irrespective of the vertical scan position. This makes it possible to correct vertical uneven light emission in a striped fashion (stripes of uneven light emission stretching in the vertical direction) at the brightness level L1.

Further, uneven light emission in a striped fashion at the brightness levels L2 and L3 is similarly corrected respectively using the pieces of correction data DB2 and DB3. It should be noted that the correction data for brightness levels other than L1, L2 and L3 can be obtained by interpolating the pieces of correction data DB1 to DB3.

On the other hand, the pieces of correction data DC1 to DC3 are available in cross-hatched form as illustrated in FIG. 4C. Therefore, the correction data associated with the scan position (coordinate position) of the organic EL panel 42 can be formed by interpolating these pieces of correction data DC1 to DC3, thus allowing for correction of local uneven light emission.

As described above, the correction circuit 20 handles various corrections, including color temperature adjustment, correction of the change of white balance over time, correction of the organic EL panel 42 for phosphor burn-in and uneven light emission and limitation of the maximum brightness. The resultant image is displayed on the organic EL panel 42.

[4] Configuration Example of the Uneven Light Emission Correction Circuit 26

Figure 5:
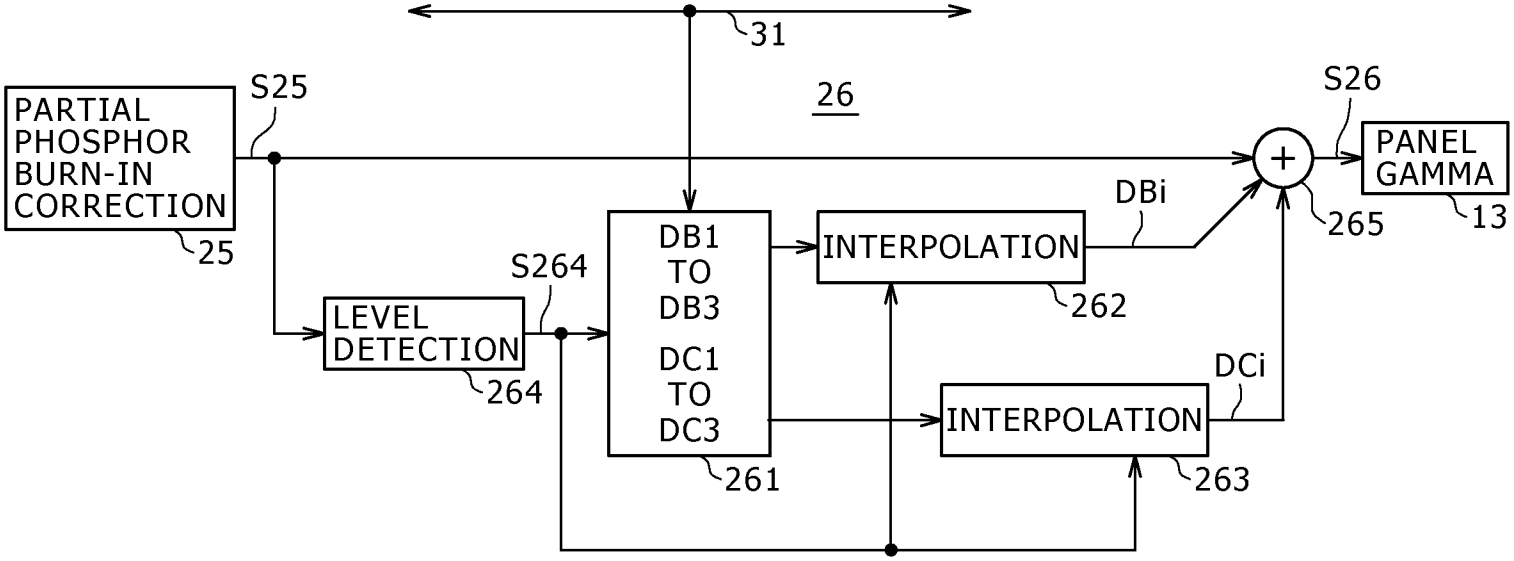
FIG. 5 is a diagram for illustrating a configuration example of a part of the circuit shown in FIG. 1.

FIG. 5 illustrates a configuration example of the uneven light emission correction circuit 26. That is, the same circuit 26 includes not only the memory 261 mentioned earlier but also other components such as interpolation circuits 262 and 263. In this case, the memory 261 serves as a buffering or working memory adapted to repeatedly read the pieces of correction data DB1 to DB3 and DC1 to DC3 from the non-volatile memory 52.

Therefore, when the display device is powered on, the microcomputer 51 reads the pieces of correction data DB1 to DB3 and DC1 to DC3 from the non-volatile memory 52 and writes them to the memory 261 for storage. On the other hand, the video signal S25 from the partial phosphor burn-in correction circuit 25 is supplied to an addition circuit 265 as a main signal (signal to be corrected).

Further, the video signal S25 from the partial phosphor burn-in correction circuit 25 is supplied to a level detection circuit 264 so that the level (voltage) of the video signal S25 is detected. A detection signal S264 thereof is supplied to the memory 261. As a result, of the pieces of correction data DB1 to DB3 and DC1 to DC3 stored in the memory 261, the piece of data is read which is associated with the level represented by the detection signal S264 and also with the horizontal and vertical scan positions.

For example, when the level (voltage) of the video signal S25 is smaller than the voltage level V2 associated with the brightness level L2, the piece of correction data associated with the scan position at this time is read of all the pieces of data DB1 and DB2 (or DC1 and DC2). When the level of the video signal S25 is greater than the voltage level V2, the piece of correction data associated with the scan position at this time is read of all the pieces of data DB2 and DB3 (or DC2 and DC3).

As a result, the piece of correction data read, namely, DB1, DB2 or DB3, is supplied to the interpolation circuit 262. Further, the detection signal S264 is supplied to the same circuit 262. A piece of correction data DBi associated with the level of the detection signal S264 is formed by interpolation based on the piece of correction data DB1, DB2 or DB3. The correction data DBi thus formed is supplied to the addition circuit 265 and added to the video signal S25.

Further, the piece of correction data read from the memory 261, namely, DC1, DC2 or DC3, is supplied to the interpolation circuit 263. At the same time, the detection signal S264 is supplied to the same circuit 263. A piece of correction data DCi associated with the level of the detection signal S264 is formed by interpolation based on the piece of correction data DC1, DC2 or DC3. The correction data DCi thus formed is supplied to the addition circuit 265 and added to the video signal S25.

When the level of the video signal S25 is smaller than the voltage level V1 associated with the brightness level L1, the value 0 and the pieces of correction data DB1 and DC1 are supplied respectively to the interpolation circuits 262 and 263 for interpolation at the boundary level. Thus, the correction data is extracted from the memory 261 for interpolation in the interpolation circuits 262 and 263. The correction data is extracted adaptively based on the voltage levels associated with the brightness level L1, L2 and L3, namely, according to the level of the video signal S25.

As a result, the addition circuit 265 outputs the video signal S26 which has been corrected in terms of horizontal and vertical uneven light emission in a striped fashion by the correction data DBi and also corrected in terms of local uneven light emission by the correction data DCi. Thus, the uneven light emission correction circuit 26 corrects not only horizontal and vertical uneven light emission in a striped fashion but also local uneven light emission.

In this case, the correction of uneven light emission demands several pieces of horizontal correction data and several pieces of vertical correction data, namely, several pieces of one-dimensional correction data, to be available in the non-volatile memory 52 and the memory 261 which is supplied with the pieces of correction data DB1 to DB3 and DC1 to DC3 from the memory 52, as illustrated in FIGS. 4B and 4C. This eliminates the need for any large-capacity memory, thus keeping down the costs.

[5] Conclusion

According to the display correction circuit 10 described above, the correction circuit 20 corrects uneven light emission of the organic EL panel 42 using the uneven light emission correction circuit 26, thus providing a high quality image and ensuring improved manufacturing yield of the organic EL panel 42.

Figure 2E:
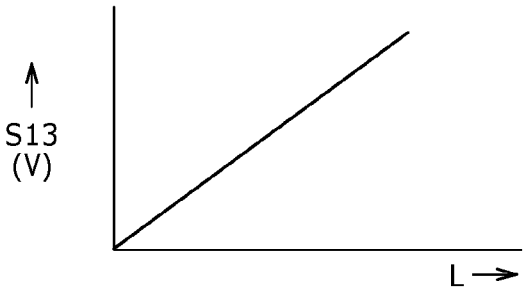

In all corrections performed by the correction circuit 20, the video signal S1 having a gamma characteristic for the cathode ray tube is converted into the video signal S12 having a linear gamma characteristic as illustrated in FIG. 2E by the linear gamma circuit 12. All corrections and level detection for the corrections are performed on the video signal S12, thus providing a reliable means of performing the corrections with a simple circuit configuration.

Figure 6:
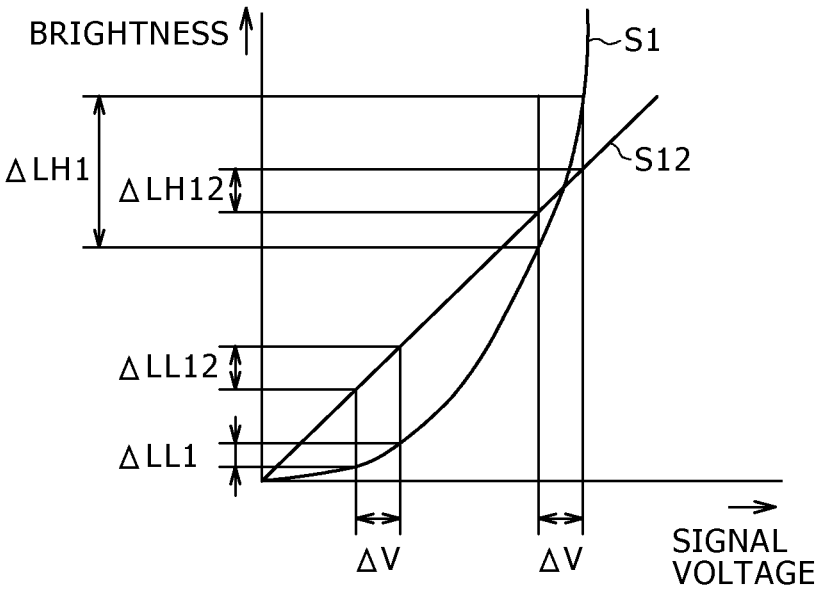
FIG. 6 is a characteristic diagram for describing the operation of the circuit shown in FIG. 1.

That is, the input video signal S1 has a gamma characteristic as illustrated in FIG. 6. We assume that the video signal S1 (or video signal S11) is subjected to a correction. In this case, even if a voltage change ΔV at a low voltage level is equal to the voltage change ΔV at a high voltage level, a brightness change ΔLL1 relative to the voltage change ΔV at a low voltage level differs from a brightness change ΔLH1 relative to the voltage change ΔV at a high voltage level.

That is, correction sensitivities (ΔLL1/ΔV, ΔLH1/ΔV) differ from each other according to the voltage level of the video signal S1. Therefore, if various corrections are performed as mentioned earlier, the control range (ΔV) must be changed according to the level of the video signal S1 for each correction. This leads to a more complicated configuration of the correction circuit 10, possibly resulting in less-than-optimal corrections.

However, the display correction circuit 10 converts the input video signal S1 into the video signal S12 having a linear characteristic as illustrated in FIG. 2C using the linear gamma circuit 12. Thus, the video signal S12 (or signals S21 to S25), rather than the video signal S1, is subjected to the corrections. This ensures that the brightness change ΔLL12 relative to the voltage change ΔV at a low voltage level of the video signal S12 is equal to the brightness change ΔLH12 relative to the voltage change ΔV at a high voltage level thereof as shown in FIG. 6.

That is, the correction sensitivities (ΔLL12/ΔV, ΔLH12/ΔV) are equal to each other, irrespective of the voltage level of the video signal S12. This makes it possible for the correction circuit 20 to correct the video signal S12 properly during the corrections, thus simplifying a circuit configuration. In particular, the video signal having a linear gamma characteristic is corrected in a subtle manner, as in the correction of uneven light emission of the organic EL panel 42. This ensures reliable correction, thus providing further improved image quality.

Moreover, the video signal S12 (signals S21 to S25), converted by the linear gamma circuit 12 to have a linear characteristic as illustrated in FIG. 2C, is subjected to a gamma correction for the organic EL panel 42 by the panel gamma circuit 13. This ensures a proper gamma correction for the organic EL panel having a different gamma characteristic, achieving a high quality image on the screen.

Further, the video signal used for various detections by the detection circuits 33 to 35 has a linear characteristic. This provides the same video signal detection sensitivity irrespective of the signal level, ensuring high detection accuracy and providing a high quality image.

[6] Others

If the same gamma characteristic as the video signal S1 is imparted to the test video signal from the pattern generator 21 in the above description, the pattern generator 21 may be provided in the previous stage of the linear gamma circuit 12.

Further, the uneven light emission correction circuit 26 uses two sets of correction data, each set including three pieces of data, namely, DB1, DB2 and DB3, and DC1, DC2 and DC3, respectively for the brightness levels L1, L2 and L3, in the above description. However, the number of brightness levels and the numbers of horizontal and vertical scan positions may be changed according to the performance and manufacturing yield of the organic EL panel 42.

Still further, in the above description, the organic EL panel 42 is caused to emit light across the surface, after which the surface thereof is captured with a video camcorder or other imaging means to detect uneven light emission at the horizontal and vertical scan positions illustrated in FIGS. 4B and 4C. Alternatively, however, the same panel 42 may be caused to emit light at the horizontal and vertical scan positions illustrated in FIGS. 4B and 4C sequentially one after another. In this case, emitted light is received by photocells such as photodiodes or phototransistors for detection of uneven light emission at these horizontal and vertical scan positions.

Further, an inverse gamma correction may be performed adaptively for the transistor Q of each pixel according to the display area or signal level. Still further, such a correction according to the display area or signal level may be performed by a separate functional block.

It should be understood by those skilled in the art that various modifications, combinations, sub-combinations and alterations may occur depending on design requirements and other factors insofar as they are within the scope of the appended claims or the equivalents thereof.

[LIST OF THE ACRONYMS]

ABL: Automatic Brightness Limiter
EL: Electro Luminescence
FPGA: Field Programmable Gate Array
IC: Integrated Circuit
LED: Light Emitting Diode
LSI: Large Scale Integration
OLED: Organic Light Emitting Diode
RSDS: Reduced Swing Differential Signaling (registered trademark)
TFT: Thin Film Transistor
LASER: Light Amplification by Stimulated Emission of Radiation

What is claimed is:

1. A display correction circuit of an organic EL panel, the display correction circuit comprising:

a signal forming unit configured to form a signal that is supplied to an organic EL panel and sequentially changes, for each predetermined scan position on the organic EL panel, a brightness level at the scan position;

a non-volatile memory configured to store first correction data and second correction data that correct, for each brightness level, uneven light emission in a horizontal direction and a vertical direction at the scan position on the organic EL panel, and third correction data that corrects uneven light emission which locally occurs on the organic EL panel, when the first correction data, the second correction data and the third correction data are formed from a detection output that detects brightness at the scan position for each change in the brightness level;

a correction circuit configured to correct a level of a video signal that is supplied to the organic EL panel;

a linear gamma circuit configured to receive a video signal that has been subjected to predetermined non-linear gamma correction, to cancel the gamma correction on the received video signal, to convert the received video signal to a video signal with a linear gamma property, and to output the converted video signal to the correction circuit; and a panel gamma circuit configured to receive a video signal that is output from the correction circuit, to convert the received video signal to a video signal with a gamma property corresponding to a gamma property of the organic EL panel, and to output the converted video signal to the organic EL panel, wherein, the correction data is read from the memory during viewing, with the read correction data, the first correction data and the second correction data are used to correct the uneven light emission that occurs in the horizontal direction and the vertical direction on the organic EL panel in accordance with the scan position and the brightness level, the third correction data is then used to correct the uneven light emission that locally occurs on the organic EL panel, and the panel gamma circuit is supplied with the level of the video signal output from the linear gamma circuit and received by the correction circuit, the first correction data includes an average correction value for all horizontal lines of the EL panel, the second correction data includes an average correction value for all vertical lines of the EL panel, the level of the video signal output from the linear gamma circuit and received by the correction circuit is corrected by the formed correction data, and when the level of the video signal output from the linear gamma circuit and received by the correction circuit does not correspond to a level of the signal formed by the signal forming unit, correction data corresponding to the level of the video signal obtained by interpolating each piece of correction data stored in the memory, output from the linear gamma circuit, and received by the correction circuit is formed.

2. The display correction circuit of an organic EL panel according to claim 1, wherein the correction circuit includes:

a detection unit configured to detect a drive state or a drive history of the organic EL panel from the video signal received by the correction circuit, wherein the correction circuit is configured to correct the video signal supplied to the organic EL panel with a detection output of the detection unit.

* * * * *